US010345022B2

(12) United States Patent
Najima

(10) Patent No.: US 10,345,022 B2
(45) Date of Patent: Jul. 9, 2019

(54) AIR-CONDITIONING APPARATUS

(71) Applicant: Mitsubishi Electric Corporation, Tokyo (JP)

(72) Inventor: Kohei Najima, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 15/580,711

(22) PCT Filed: Aug. 14, 2015

(86) PCT No.: PCT/JP2015/072966

§ 371 (c)(1),
(2) Date: Dec. 8, 2017

(87) PCT Pub. No.: WO2017/029695

PCT Pub. Date: Feb. 23, 2017

(65) Prior Publication Data

US 2018/0187936 A1 Jul. 5, 2018

(51) Int. Cl.
*F25B 47/02* (2006.01)
*F25B 13/00* (2006.01)
(Continued)

(52) U.S. Cl.
CPC ..... *F25B 47/025* (2013.01); *F24F 11/42* (2018.01); *F24F 11/65* (2018.01); *F25B 13/00* (2013.01);
(Continued)

(58) Field of Classification Search
CPC ..... F25B 47/025; F25B 1/00; F25B 13/00; F25B 41/046; F25B 47/02; F25B 49/022;
(Continued)

(56) References Cited

U.S. PATENT DOCUMENTS 5,651,263 A 7/1997 Nonaka et al.
2011/0072839 A1* 3/2011 Itagaki ..... F25B 30/02 62/222

(Continued)

FOREIGN PATENT DOCUMENTS

JP H08-136068 A 5/1996
JP H08-178396 A 7/1996

(Continued)

OTHER PUBLICATIONS

International Search Report of the International Searching Authority dated Nov. 10, 2015 for the corresponding nternational application No. PCT/JP2015/072966 (and English translation).

*Primary Examiner* — Melvin Jones
(74) *Attorney, Agent, or Firm* — Posz Law Group, PLC

(57) ABSTRACT

An air-conditioning apparatus is configured to melt a large amount of adhering frost while maintaining an appropriate operation of a compressor by setting a defrosting operation time period depending on a low pressure of the compressor. The air-conditioning apparatus includes a refrigerant circuit including the compressor, a refrigerant flow switching device, a heat source-side heat exchanger, an expansion device, and a use-side heat exchanger, which are connected via a refrigerant pipe to form a refrigeration cycle, a pressure sensor configured to detect a pressure on a suction side of the compressor, and a controller configured to control, in a defrosting operation, the refrigerant flow switching device to supply compressed refrigerant from the compressor to the heat source-side heat exchanger, compare a value detected by the pressure sensor with a first threshold value, and change the defrosting operation time period based on a result of the comparison.

4 Claims, 7 Drawing Sheets

(51) Int. Cl.

| | |
|---|---|
| ***F25B 41/04*** | (2006.01) |
| ***F25B 49/02*** | (2006.01) |
| ***F24F 11/65*** | (2018.01) |
| ***F24F 11/42*** | (2018.01) |
| *F24F 140/12* | (2018.01) |
| *F24F 140/20* | (2018.01) |

(52) U.S. Cl.
CPC ..... *F25B 41/046* (2013.01); *F25B 49/022* (2013.01); *F25B 49/027* (2013.01); *F24F 2140/12* (2018.01); *F24F 2140/20* (2018.01); *F25B 2313/0292* (2013.01); *F25B 2313/0293* (2013.01); *F25B 2313/0294* (2013.01); *F25B 2313/02322* (2013.01); *F25B 2600/25* (2013.01); *F25B 2600/2501* (2013.01); *F25B 2700/1933* (2013.01); *F25B 2700/21151* (2013.01)

(58) Field of Classification Search
CPC ..... F25B 49/027; F25B 2600/25; F25B 2313/02322; F25B 2313/0292; F25B 2313/0293; F25B 2313/0294; F25B 2600/2501; F25B 2700/1933; F25B 2700/21151; F24F 11/89; F24F 11/42; F24F 11/65; F24F 2140/12; F24F 2140/20
See application file for complete search history.

(56) References Cited

U.S. PATENT DOCUMENTS

| | | | | |
|---|---|---|---|---|
| 2014/0033750 | A1* | 2/2014 | Tanaka | F25B 13/00 62/151 |
| 2015/0075196 | A1* | 3/2015 | Yanachi | F25B 13/00 62/160 |
| 2015/0300723 | A1* | 10/2015 | Tsukino | F25B 47/025 62/128 |
| 2016/0178261 | A1* | 6/2016 | Kimura | F25B 13/00 62/155 |

FOREIGN PATENT DOCUMENTS

| | | | |
|---|---|---|---|
| JP | H11-337234 | A | 12/1999 |
| JP | 2001-272144 | A | 10/2001 |
| JP | 2008-138921 | A | 6/2008 |
| JP | 2011-169591 | A | 9/2011 |

* cited by examiner

AIR-CONDITIONING APPARATUS

CROSS REFERENCE TO RELATED APPLICATION

This application is a U.S. national stage application of PCT/JP2015/072966 filed on Aug. 14, 2015, the contents of which are incorporated herein by reference.

TECHNICAL FIELD

The present invention relates to an air-conditioning apparatus, in which a heat source is included in an outdoor unit, for example.

BACKGROUND ART

Among air-conditioning apparatus, for example, multi-air-conditioning apparatus for buildings, there is a type in which a compressor serving as a heat source is included in an outdoor unit, which is installed outside a construction. When such air-conditioning apparatus performs a heating operation, refrigerant circulating through a refrigerant circuit of the air-conditioning apparatus removes heat from outside air in a heat exchanger of the outdoor unit, and transfers heat to air that is supplied to a heat exchanger of an indoor unit to heat air to be sent into a space to be air-conditioned. Meanwhile, when the air-conditioning apparatus performs a cooling operation, the refrigerant circulating through the refrigerant circuit removes heat from air that is supplied to the heat exchanger of the indoor unit to cool air to be sent into the space to be air-conditioned, and transfers heat in the heat exchanger of the outdoor unit.

When the heating operation is performed with the outdoor unit being installed outdoors, moisture in the air condenses through the heat removal in the outdoor unit and adheres to the heat exchanger of the outdoor unit. When an outside air temperature is low as in winter, the adhering moisture is solidified to form frost. When a large amount of frost adheres to a surface of the heat exchanger, a reduction in heat exchange capacity, a failure of the heat exchanger, and other problems are caused. To address those problems, a defrosting operation is periodically performed to melt and hence remove frost.

In Patent Literature 1, there is disclosed a technology in which, when the defrosting operation is performed, a ventilation function of an air-conditioning apparatus is stopped. Moreover, in Patent Literature 2, there is disclosed a technology in which an absolute humidity is calculated based on a relationship between a temperature around a cooling device and a relative humidity, and it is determined whether or not to start the defrosting operation based on the absolute humidity. In both of Patent Literature 1 and Patent Literature 2, there is performed the defrosting operation in which high-temperature gas refrigerant that has flowed out of the compressor, which has been supplied to the heat exchanger of the indoor unit, is changed in flow direction to flow to the heat exchanger of the outdoor unit, thereby increasing a temperature around a pipe to melt frost.

CITATION LIST

Patent Literature

Patent Literature 1: Japanese Unexamined Patent Application Publication No. 2011-169591

Patent Literature 2: Japanese Unexamined Patent Application Publication No. Hei 8-178396

SUMMARY OF INVENTION

Technical Problem

When an air-conditioning apparatus is operated in an extremely low-temperature environment with an outside air temperature of −20 degrees C. or less, for example, in order to melt frost adhering to the heat exchanger, the temperature around the pipe is required to be increased to a temperature at which frost is completely melted. However, general air-conditioning apparatus in the related art including Patent Literature 1 and Patent Literature 2 are not contemplated for use in the extremely low-temperature environment. Therefore, the large amount of adhering frost is not completely melted, and the defrosting operation may be ended while frost remains.

In this case, it can be expected that frost may be melted quickly when a frequency of a compressor is set to a large value to increase a flow rate of the high-temperature refrigerant that is discharged from the compressor. However, when the frequency is increased, a low pressure of the compressor is lowered. A lower limit value is set to the low pressure of the compressor to avoid a failure accompanying the reduction in low pressure and other problems. Therefore, an upper limit value of the frequency of the compressor is set such that the low pressure of the compressor is not lowered too much.

Moreover, the defrosting operation is performed by changing the flow direction of the refrigerant that has been supplied to the heat exchanger of the indoor unit during the heating operation, and hence a defrosting time period is generally set as short as possible. Therefore, even when frost is not completely removed, the defrosting operation is ended immediately after the defrosting time period has elapsed.

As described above, when a large amount of frost adheres to a heat source-side heat exchanger, it is difficult to completely melt frost. In addition, when the defrosting operation is ended and normal operation is resumed while frost remains, frost further accumulates on the remaining frost, and it becomes more difficult to remove frost.

The present invention has been made to solve the above-mentioned problems, and therefore has an object to provide an air-conditioning apparatus, which is capable of removing frost adhering to an outdoor unit while maintaining an appropriate operation of a compressor.

Solution to Problem

According to one embodiment of the present invention, there is provided an air-conditioning apparatus including: a refrigerant circuit, in which a compressor, a refrigerant flow switching device, a heat source-side heat exchanger, an expansion device, and a use-side heat exchanger are connected via a refrigerant pipe to form a refrigeration cycle; a pressure sensor which is configured to detect a pressure on a suction side of the compressor; and a controller, which is configured to control, in a defrosting operation, the refrigerant flow switching device to supply compressed refrigerant from the compressor to the heat source-side heat exchanger, compare a value detected by the pressure sensor with a first threshold value, and change a defrosting operation time period based on a result of the comparison.

Advantageous Effects of Invention

According to the air-conditioning apparatus of the embodiment of the present invention, the pressure on the suction side of the compressor in operation is compared with the first threshold value, and the defrosting operation time period is changed based on the result of the comparison. In this manner, the defrosting operation time period is set while focusing attention on the pressure on the suction side of the compressor, and when the pressure on the suction side of the compressor is the first threshold value or more, the defrosting operation time period is set longer than that when the pressure on the suction side of the compressor is less than the first threshold value, for example. When the defrosting operation time period is set longer, an amount of heat with which frost adhering to the heat exchanger of the outdoor unit is melted is increased, and frost is removed more reliably.

DESCRIPTION OF EMBODIMENTS

Embodiment 1

An air-conditioning apparatus according to Embodiment 1 of the present invention includes a refrigerant circuit forming a refrigeration cycle in which refrigerant circulates. In the air-conditioning apparatus, for each of a plurality of connected indoor units, a cooling operation mode or a heating operation mode is selected and set as an operation mode. In a case of a cooling and heating mixed operation, the "heating operation mode" refers to a mode at a time when a heating operation is performed for all the indoor units or with a larger heating load, and the "cooling operation mode" refers to a mode at a time when a cooling operation is performed for all the indoor units or with a larger cooling load.

In the following description, an air-conditioning apparatus including one indoor unit and one outdoor unit is described as an example, but a configuration of the indoor unit and the outdoor unit forming the air-conditioning apparatus is not limited thereto. The air-conditioning apparatus may have a configuration in which a plurality of indoor units are connected for one outdoor unit, for example, and the above-mentioned cooling and heating mixed operation may be performed in that case.

Figure 1:
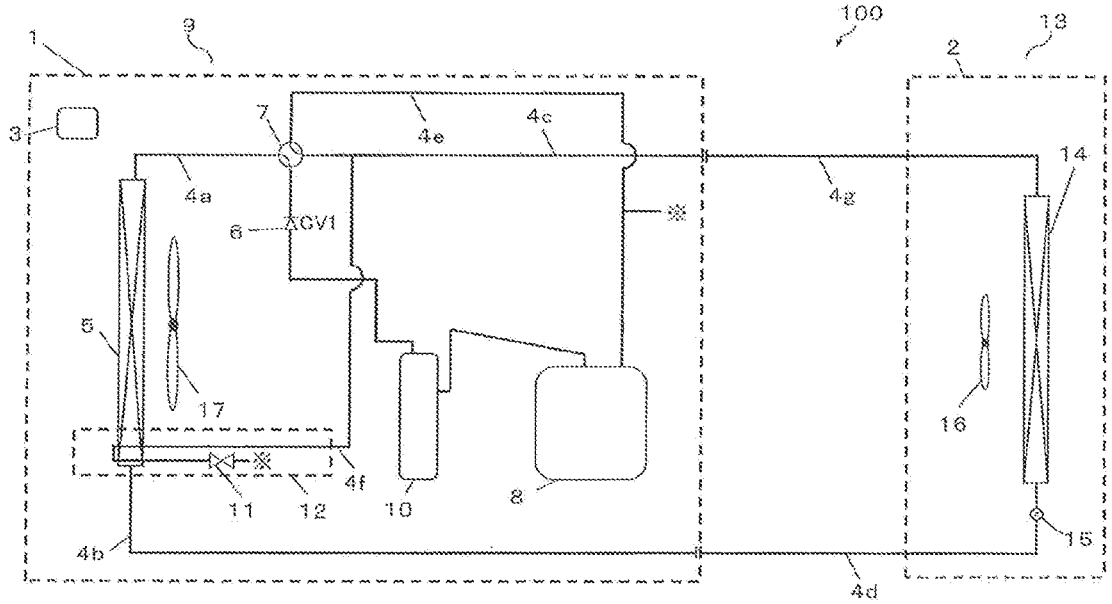
FIG. 1 is a schematic diagram for illustrating an installation example of an air-conditioning apparatus according to Embodiment 1 of the present invention.

FIG. 1 is a schematic diagram for illustrating an installation example of an air-conditioning apparatus 100 according to Embodiment 1. As illustrated in FIG. 1, the air-conditioning apparatus 100 according to Embodiment 1 includes an outdoor unit 1, which serves as a heat source unit, and an indoor unit 2, each of which is controlled by a controller 3. The outdoor unit 1 and the indoor unit 2 have their elements connected via a cooling pipe including pipes 4*a* to 4*g* to form a refrigerant circuit. In the following description, the pipes 4*a* to 4*g* are collectively referred to as "cooling pipe 4". Through the cooling pipe 4, a zeotropic refrigerant mixture, for example, flows as the refrigerant.

[Outdoor Unit 1]

In the outdoor unit 1, a compressor 10, a check valve 6, a refrigerant flow switching device 7, a heat source-side heat exchanger 5, and an accumulator 8 are arranged, and are connected via the pipes 4*a*, 4*b*, 4*c*, and 4*e* to form a part of the refrigerant circuit.

The compressor 10 is connected to a use-side heat exchanger 14 of the indoor unit 2 via the accumulator 8, which is connected to a suction side of the compressor 10, and is configured to suck the refrigerant that flows from the accumulator 8, compress the refrigerant, and discharge the refrigerant in a high-temperature and high-pressure state. The compressor 10 is connected to the refrigerant flow switching device 7 on a discharge side. The compressor 10 also includes a safety device configured to stop operation when a low pressure Ls falls below a lower limit value, and a pressure sensor 19 (see FIG. 2) configured to detect the low pressure Ls is provided in the refrigerant circuit on the suction side of the compressor 10. The compressor 10 is an inverter compressor having a capacity that is controllable by controlling a frequency of the compressor, for example.

The refrigerant flow switching device 7 is formed of a four-way valve, for example, and is configured to switch a flow passage between a flow of the refrigerant during the heating operation and a flow of the refrigerant during the cooling operation. The check valve 6 is arranged between the compressor 10 and the refrigerant flow switching device 7, and is configured to prevent the refrigerant from flowing from the refrigerant flow switching device 7 toward the compressor 10.

The heat source-side heat exchanger 5 serves as an evaporator during the heating operation, and serve as a condenser during the cooling operation. On the pipe 4*b* connected to the heat source-side heat exchanger 5, a temperature sensor 18 (see FIG. 2) configured to measure a pipe temperature is arranged. Moreover, in a lower portion of the heat source-side heat exchanger 5, there is provided a base heat exchanger 12 configured to prevent a drain hole (not shown), which is configured to drain condensed water dwelling in the lower portion of the heat source-side heat exchanger 5, from being frozen. The base heat exchanger 12 is connected to the pipe 4*f*, which branches off the pipe 4*c*. The pipe 4*f* serves as a bypass, and a solenoid valve 11 is mounted therein. The solenoid valve 11 is a valve configured to regulate a flow rate of the bypass. An outdoor unit fan 17 is provided in the vicinity of the heat source-side heat exchanger 5, and air from an outdoor space 9 is supplied to the heat source-side heat exchanger 5, thereby heat is exchanged between the refrigerant and air.

The accumulator 8 is provided on the suction side of the compressor 10, and is configured to accumulate excess refrigerant generated by a difference in setting between the heating operation mode and the cooling operation mode, and excess refrigerant generated due to a transient change in operation, for example, a change in number of operating indoor units 2, or a change in load condition. In the accumulator 8, the refrigerant is separated into a liquid phase containing more high-boiling refrigerant and a gas phase containing more low-boiling refrigerant. Then, the refrigerant in the liquid phase containing more high-boiling refrigerant is accumulated in the accumulator 8. Therefore, when the refrigerant in the liquid phase exists in the accumulator 8, a composition of the refrigerant circulating through the air-conditioning apparatus 100 exhibits a tendency to contain more low-boiling refrigerant.

[Indoor Unit 2]

The indoor unit 2 includes the use-side heat exchanger 14 and an expansion device 15, and is connected to the outdoor unit 1 via the cooling pipe 4. As a result, the refrigerant circuit is formed in the air-conditioning apparatus 100. An indoor unit fan 16 is provided in the vicinity of the use-side heat exchanger 14, and heat is exchanged between air supplied by the indoor unit fan 16 and the refrigerant flowing through the use-side heat exchanger 14, thereby heating air or cooling air to be supplied to an indoor space 13 is generated.

[Controller]

Figure 2:
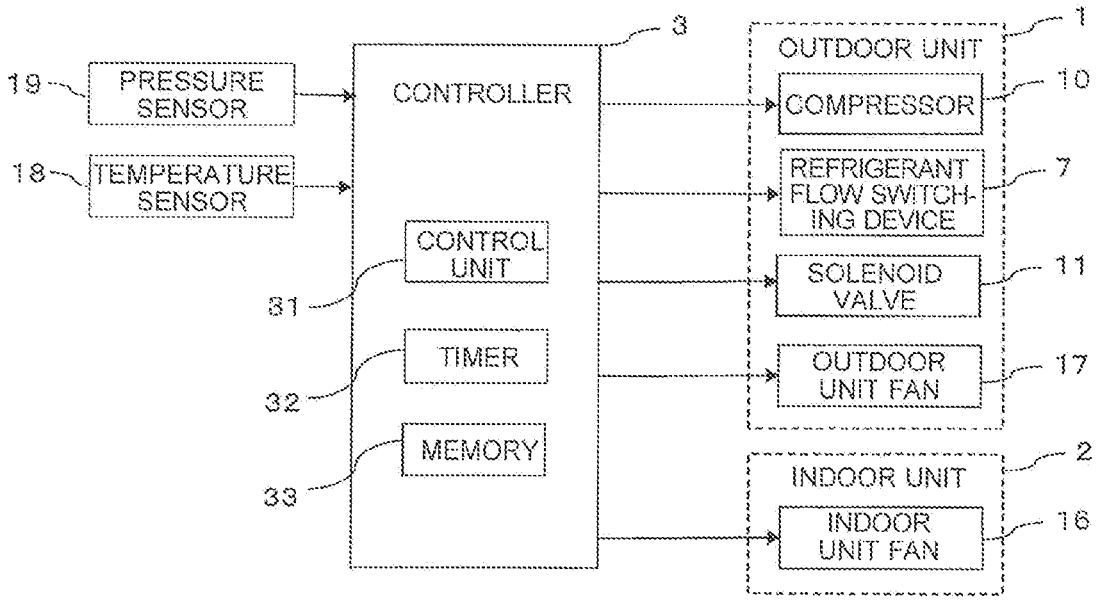
FIG. 2 is a functional block diagram for illustrating an example of a controller of the air-conditioning apparatus of FIG. 1.

FIG. 2 is a functional block diagram for illustrating an example of the controller 3 of the air-conditioning apparatus 100 of FIG. 1. As illustrated in FIG. 2, the controller 3 includes a control unit 31, a timer 32 configured to detect time, and a memory 33 configured to store various kinds of data. The controller 3 is formed of a microcomputer, for example, and a CPU executes a program stored in the memory 33 to achieve functions as the control unit 31 and the timer 32. The controller 3 is arranged in the outdoor unit 1, for example. The controller 3 is notified of the low pressure Ls, which is detected by the pressure sensor 19, and the pipe temperature, which is detected by the temperature sensor 18. The controller 3 is configured to control the refrigerant flow switching device 7, the compressor 10, the indoor unit fan 16, and the outdoor unit fan 17 based on those pieces of information. In FIG. 2, components relating to defrosting, which is a feature of Embodiment 1, are mainly illustrated, and various other sensors are omitted.

[Description of Operation Mode]

The air-conditioning apparatus 100 has the cooling operation and the heating operation, which are performed by being selected by a user, and a defrosting operation, which is performed by interrupting the heating operation when defrosting start conditions are satisfied during the heating operation, as operation modes, which are executed selectively. Then, during the heating operation that is resumed after the defrosting operation is ended, a root ice eliminating operation is executed in parallel to the heating operation for a predetermined time period. The root ice eliminating operation is performed to melt high-density ice, which is formed when water in the lower portion of the heat source-side heat exchanger 5 is frozen, and is performed using the base heat exchanger 12 configured to prevent the drain hole from being frozen.

[Cooling Operation]

Figure 3:
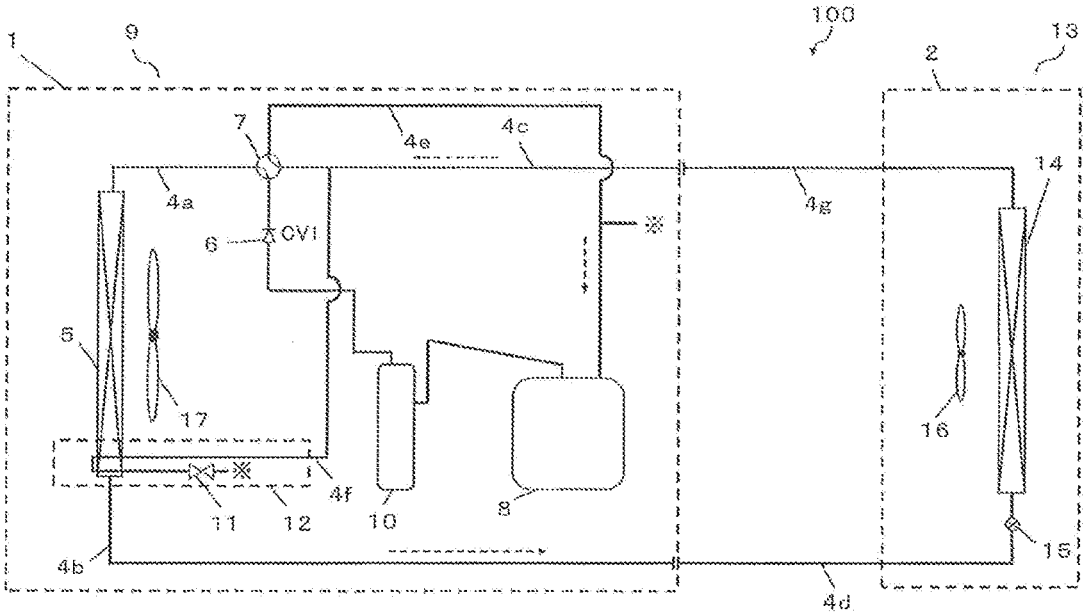
FIG. 3 is a schematic diagram for illustrating a cooling operation in the air-conditioning apparatus of FIG. 1.

FIG. 3 is a schematic diagram for illustrating the cooling operation in the air-conditioning apparatus 100 of FIG. 1, and the broken-line arrows indicate a flow direction of the refrigerant. As illustrated in FIG. 3, during the cooling operation, the refrigerant flow switching device 7 is controlled such that the compressor 10, the heat source-side heat exchanger 5, the expansion device 15, the use-side heat exchanger 14, and the accumulator 8 are connected in a loop to form the refrigeration cycle. In this refrigeration cycle, the heat source-side heat exchanger 5 serves as the condenser, and the use-side heat exchanger 14 serves as an evaporator. The high-temperature and high-pressure refrigerant that has flowed out of the discharge side of the compressor 10 of the indoor unit 2 transfers heat in the heat source-side heat exchanger 5, is changed to low-temperature and low-pressure refrigerant by the expansion device 15, and flows into the use-side heat exchanger 14 to remove heat from the indoor space 13, thereby cooling is performed. Then, the refrigerant that has removed heat flows out of the use-side heat exchanger 14, and returns to the compressor 10 through the accumulator 8.

[Heating Operation]

Figure 4:
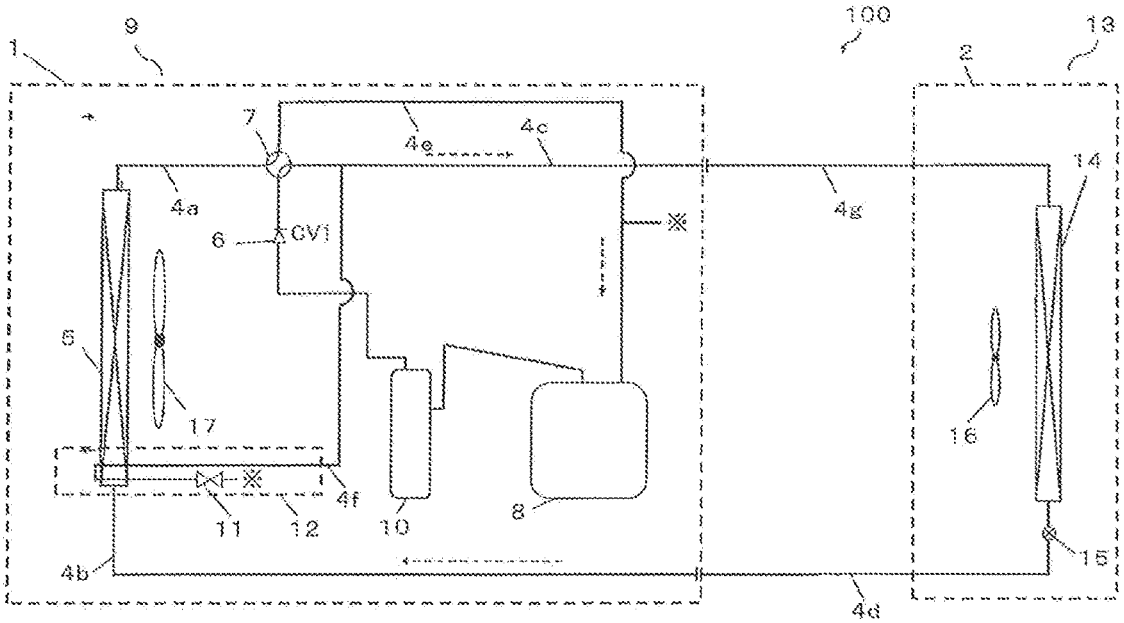
FIG. 4 is a schematic diagram for illustrating a heating operation in the air-conditioning apparatus of FIG. 1.

FIG. 4 is a schematic diagram for illustrating the heating operation in the air-conditioning apparatus 100 of FIG. 1. As illustrated in FIG. 4, during the heating operation, the refrigerant flow switching device 7 is controlled such that the compressor 10, the use-side heat exchanger 14, the expansion device 15, the heat source-side heat exchanger 5, and the accumulator 8 are connected in a loop to form the refrigeration cycle. In this refrigeration cycle, the use-side heat exchanger 14 serves as a condenser, and the heat source-side heat exchanger 5 serves as the evaporator. The high-temperature and high-pressure refrigerant that has flowed out of the discharge side of the compressor 10 of the indoor unit 2 flows into the use-side heat exchanger 14 to transfer heat to the indoor space 13, thereby heating is performed. The refrigerant that has flowed out of the use-side heat exchanger 14 is changed to low-temperature and low-pressure refrigerant by the expansion device 15, and flows into the heat source-side heat exchanger 5 to remove heat. Then, the refrigerant that has removed heat flows out of the heat source-side heat exchanger 5, and returns to the compressor 10 through the accumulator 8.

[Defrosting Operation]

In the defrosting operation, which is performed to remove frost generated when the temperature at a surface of the heat source-side heat exchanger 5 is decreased during the heating operation, a refrigeration cycle similar to that in the cooling operation illustrated in FIG. 3 is formed, and the heat source-side heat exchanger 5 serves as the condenser. The defrosting operation is started when the defrosting start conditions based on the pipe temperature, which is detected by the temperature sensor 18, and cumulative operation time from a previous defrosting operation are satisfied. The defrosting start conditions are stored in the memory 33 of the controller 3, and include the pipe temperature of −8 degrees C. or less, and the cumulative operation time from the previous defrosting operation of 90 minutes, for example. A setting range of the pipe temperature may be from −5 degrees C. to −10 degrees C., and a setting range of the cumulative operation time may be from 40 minutes to 250 minutes. The setting values may be changed depending on a surrounding ambient temperature, for example.

When the defrosting operation is started, the refrigerant flow switching device 7 of the outdoor unit 1 connects the discharge side of the compressor 10 to the heat source-side heat exchanger 5. The refrigerant that has flowed into the compressor 10 is discharged in a large amount as high-temperature and high-pressure gas refrigerant from the compressor 10. The high-temperature and high-pressure gas refrigerant that has been discharged from the compressor 10 reaches the heat source-side heat exchanger 5, and exchanges heat with frost adhering to the surface of the heat source-side heat exchanger 5. As a result, frost is melted and removed from the surface of the heat source-side heat exchanger 5. While the defrosting operation is performed, rotation of the indoor unit fan 16 is stopped to prevent the low-temperature and low-pressure refrigerant that flows into the use-side heat exchanger 14 from removing heat from the indoor space 13.

[Root Ice Eliminating Operation]

After the defrosting operation is ended, the heating operation performed before the start of the defrosting operation is resumed such that the use-side heat exchanger 14 serves as the condenser, and the heat source-side heat exchanger 5 serves as the evaporator. When the heating operation is resumed, the heat source-side heat exchanger 5 removes heat to decrease the temperature around the heat source-side heat exchanger 5. Then, water generated when frost is melted in the defrosting operation is frozen again in the lower portion of the heat source-side heat exchanger 5, to thereby form high-density ice called "root ice". Root ice causes a failure of the apparatus, and hence the root ice eliminating operation for removing root ice is performed after the defrosting operation is ended.

When the root ice eliminating operation is started, the solenoid valve 11, which is arranged in the pipe 4*f* forming the bypass, is opened such that a part of the high-temperature and high-pressure gas refrigerant that has been discharged from the compressor 10 flows into the base heat exchanger 12. The refrigerant that has flowed into the base heat exchanger 12 exchanges heat with root ice formed in the lower portion of the heat source-side heat exchanger 5, and on and around a surface of the base heat exchanger 12. As a result, root ice is melted and removed.

Next, a description is given of defrosting operation control of the air-conditioning apparatus 100 configured as described above.

[Defrosting Operation Control]

Figure 5:
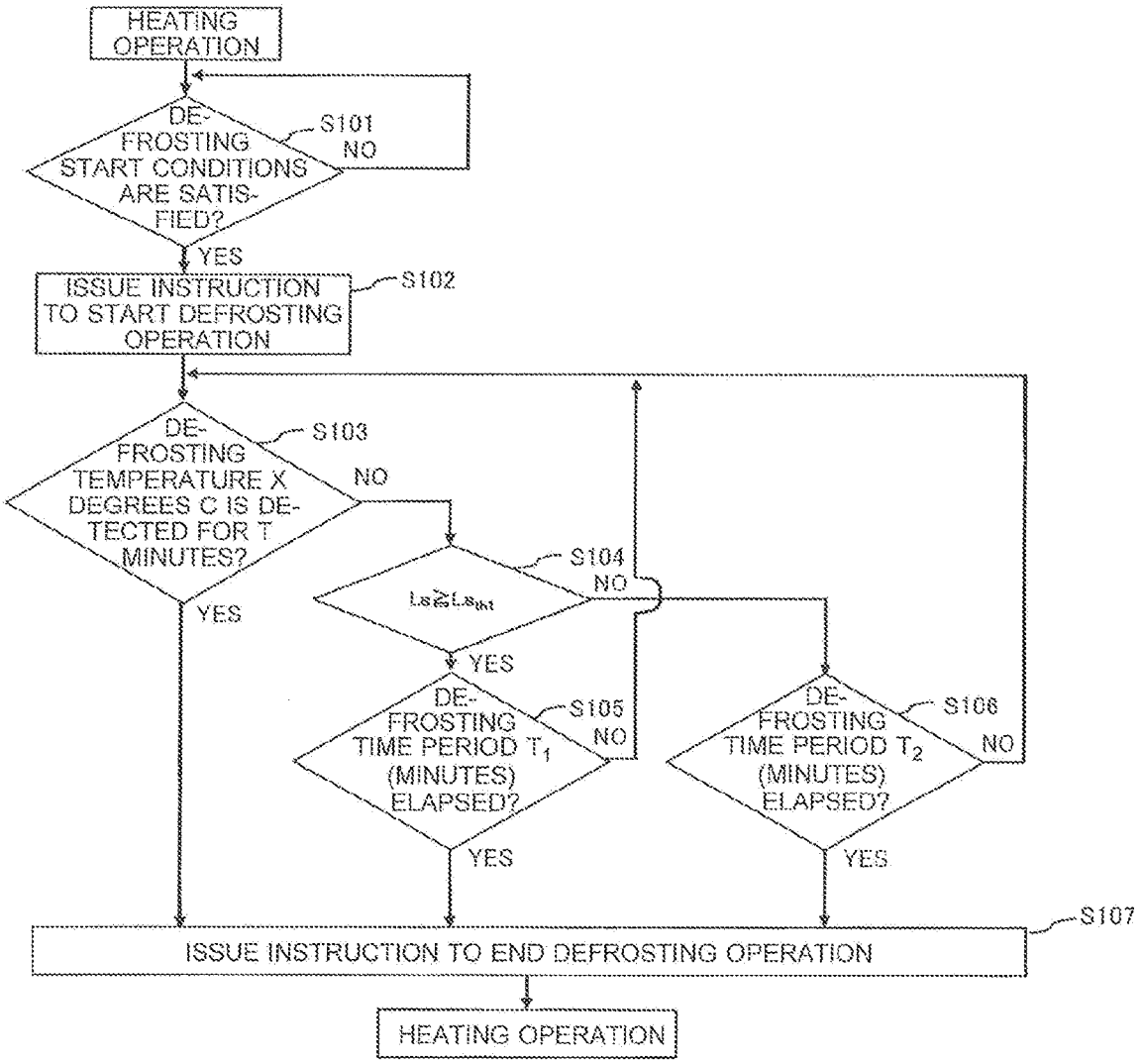
FIG. 5 is a flow chart for illustrating defrosting operation time period control performed by a control unit during a defrosting operation in the air-conditioning apparatus of FIG. 1.
Figure 6:
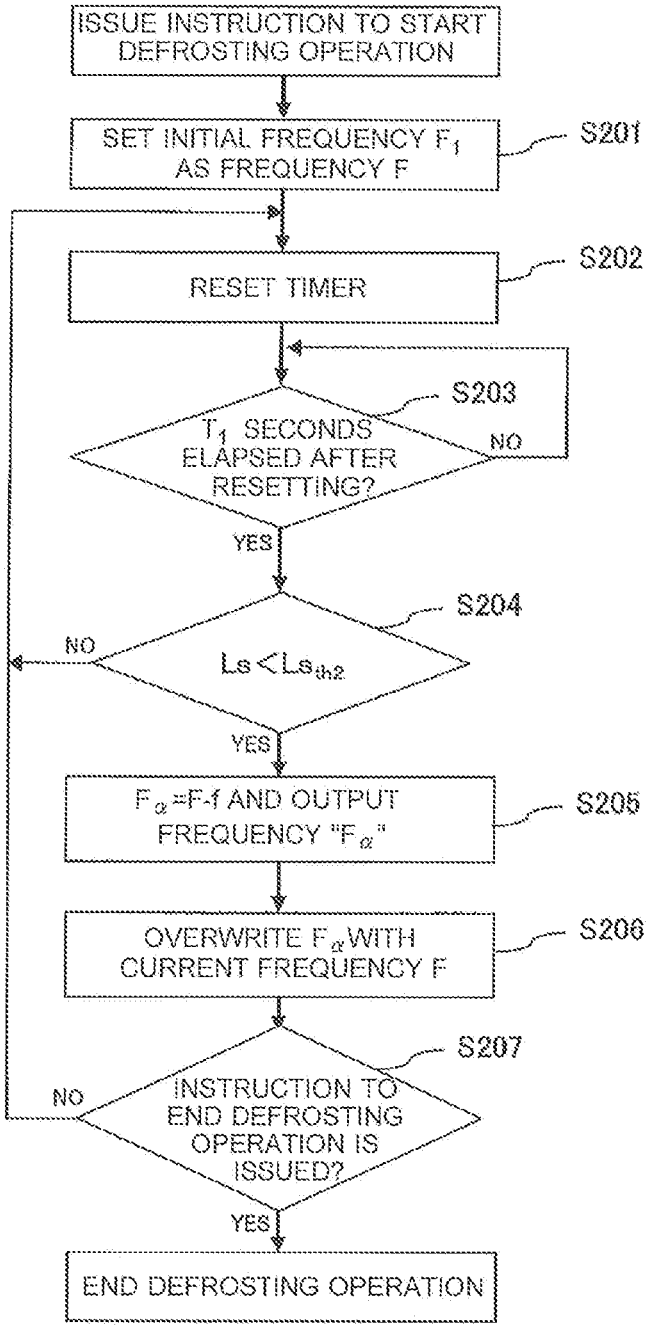
FIG. 6 is a flow chart for illustrating frequency control for a compressor performed by the control unit during the defrosting operation in the air-conditioning apparatus of FIG. 1.

The defrosting operation is performed based on the defrosting operation control by the controller 3. In the defrosting operation control, when the defrosting start conditions are satisfied, the control unit 31 starts defrosting operation time period control and frequency control. FIG. 5 is a flow chart for illustrating the defrosting operation time period control performed by the control unit 31 during the defrosting operation in the air-conditioning apparatus 100 of FIG. 1. FIG. 6 is a flow chart for illustrating the frequency control for the compressor 10 performed by the control unit 31 during the defrosting operation in the air-conditioning apparatus 100 of FIG. 1. Although the control of FIG. 5 and the control of FIG. 6 are performed in parallel, control processing of FIG. 5 and control processing of FIG. 6 are described separately.

The processing of the defrosting operation time period control of FIG. 5, which is performed by the control unit 31, is performed as follows.

(Step S101)

The control unit 31 determines whether or not the defrosting start conditions have been satisfied (Step S101). As described above, the defrosting operation is started when the defrosting start conditions based on the pipe temperature, which is detected by the temperature sensor 18, and the cumulative operation time from the previous defrosting operation are satisfied. When the control unit 31 determines that the defrosting start conditions have been satisfied, the processing proceeds to Step S102.

(Step S102)

The control unit 31 issues an instruction to start the defrosting operation, and in response to the instruction, the refrigerant flow switching device 7 switches the flow passage of the refrigeration cycle. Specifically, the refrigerant flow switching device 7 switches the flow passage from the flow passage of the refrigeration cycle of FIG. 4 to the flow passage of the refrigeration cycle of FIG. 3.

(Step S103)

Subsequently, the control unit 31 acquires the pipe temperature, which is measured by the temperature sensor 18, and determines whether a state in which the pipe temperature is a defrosting temperature X degrees C. or more has been detected consecutively for T minutes. Here, when the defrosting temperature X is 5 degrees C., and T minutes are 4 minutes, for example. When a state in which the pipe temperature is 5 degrees C. or more is maintained for 4 minutes or more, it is determined that defrosting of the heat source-side heat exchanger 5 is completed. However, in an initial stage in which defrosting has started, defrosting is in an incomplete state. Therefore, the determination result is NO, and the processing proceeds to Step S104. The defrosting temperature X, which is a reference temperature, may be set to 5 degrees C. to 10 degrees C., and the time T may be set to 4 minutes to 2 minutes.

(Step S104)

Subsequently, the control unit 31 compares the low pressure Ls of the compressor 10, which is measured by the pressure sensor 19, with a first threshold value $Ls_{th1}$, and determines whether the low pressure Ls is the first threshold value $Ls_{th1}$ or more. The first threshold value $Ls_{th1}$ is the lower limit value of the low pressure Ls at which the compressor 10 can perform an appropriate operation. In a case where the compressor 10 stops operating when the low pressure Ls of the compressor 10 is 0.5 kPa, the first threshold value $Ls_{th1}$ may be set to 0.7 kPa, for example.

(Step S105)

When it is determined in Step S104 that the low pressure Ls is the first threshold value $Ls_{th1}$ or more, the control unit 31 determines whether the time period in which the defrosting operation is performed has elapsed a first defrosting operation time period $T_1$ (minutes). When the low pressure Ls is the first threshold value $Ls_{th1}$ or more, the compressor 10 can perform the appropriate operation, and hence defrosting is performed with the first defrosting operation time period $T_1$ (minutes) being a reference operation time period. The first defrosting operation time period $T_1$ is 15 minutes, for example. Here, when the frequency of the compressor 10 has the minimum value of 60 Hz, for example, the first defrosting time period is set as a time period required to completely melt frost adhering to a pipe having a length of 10 m, for example. Then, when the control unit 31 determines that the first defrosting operation time period $T_1$ (minutes) has not elapsed since the start of the defrosting operation, the processing returns to Step S103. When the first defrosting operation time period $T_1$ (minutes) has elapsed, it is determined that defrosting of the heat source-side heat exchanger 5 is completed, and the processing proceeds to Step S107.

(Step S106)

When it is determined in Step S104 that the low pressure Ls is less than the first threshold value $Ls_{th1}$, the control unit 31 determines whether the time period in which the defrosting operation is performed has elapsed a second defrosting operation time period $T_2$ (minutes). The second defrosting operation time period $T_2$ (minutes) is a time period that is shorter than the first defrosting operation time period $T_1$ (minutes), and is set to a time period similar to general setting for a defrosting operation time period, for example, 12 minutes. When the low pressure Ls is less than the first threshold value $Ls_{th1}$, it is difficult for the compressor 10 to perform the appropriate operation. Therefore, when the low pressure Ls is less than the first threshold value $Ls_{th1}$, a defrosting time period for the compressor 10 is set to a shorter time period to maintain the appropriate operation of the compressor 10. Then, when the control unit 31 determines that the second defrosting operation time period $T_2$ (minutes) has not elapsed since the start of the defrosting operation, the processing returns to Step S103. When the second defrosting operation time period $T_2$ (minutes) has elapsed, it is determined that defrosting of the heat source-side heat exchanger 5 is completed, and the processing proceeds to Step S107.

(Step S107)

The control unit 31 repeats the above-mentioned processing of from Step S103 to Step S106 until defrosting completion conditions are satisfied in any one step. Then, when the defrosting completion conditions are satisfied in any one step, the control unit 31 instructs the refrigerant flow switching device 7 to end the defrosting operation, and switches the flow passage of the refrigeration cycle. Specifically, the control unit 31 switches the flow passage from the flow passage of the refrigeration cycle of FIG. 3 to the flow passage of the refrigeration cycle of FIG. 4.

Meanwhile, the frequency control of FIG. 6, which is performed by the control unit 31, is performed as follows.

(Step S201)

The control unit 31 sets an initial frequency $F_1$ as a frequency F of the compressor 10. The initial frequency $F_1$ of the compressor 10 is set to as large a value as possible, for example, 80 Hz. In this manner, the frequency F of the compressor 10 is set to the large value such that the large amount of high-temperature and high-pressure refrigerant is supplied to the heat source-side heat exchanger 5.

(Steps S202 and S203)

The control unit 31 resets the timer 32 (Step S202), and determines whether or not a predetermined time $t_1$ has elapsed after resetting the timer 32 (Step S203). The predetermined time $t_1$ is set to 30 seconds, for example.

(Step S204)

When determining that the predetermined time $t_1$ has elapsed, the control unit 31 acquires the low pressure Ls of the compressor 10, and compares the low pressure Ls with a second threshold value $Ls_{th2}$. The second threshold value $Ls_{th2}$ is a value that is more than the first threshold value $Ls_{th1}$, and is set to protect the compressor 10. The second threshold value $Ls_{th2}$ serves as an indicator in changing the frequency F of the compressor 10 to prevent the low pressure Ls from falling below the first threshold value $Ls_{th1}$. The first threshold value $Ls_{th1}$ is determined depending on performance of the compressor 10, and is set to 0.7 kPa, for example. The second threshold value $Ls_{th2}$ is determined based on the first threshold value $Ls_{th1}$, and is set to 0.9 kPa, for example. The time t1 is set to 30 seconds as described above, but in the frequency control, intervals at which the low pressure Ls is compared with the second threshold value $Ls_{th2}$ may be set shorter to reduce a fluctuation in low pressure Ls. Then, when the control unit 31 determines that the low pressure Ls is the second threshold value $Ls_{th2}$ or more, the appropriate operation of the compressor 10 can be performed with the frequency F at the time. Therefore, the control unit 31 maintains the frequency F, and the processing returns to Step S202. Meanwhile, when the low pressure Ls is less than the second threshold value $Ls_{th2}$, the processing proceeds to Step S205.

(Step S205)

When the low pressure Ls is less than the second threshold value $Ls_{th2}$, the control unit 31 sets a frequency $F_\alpha = F - f$ to decrease the frequency F of the compressor 10 by a predetermined value f Hz. The predetermined value f is set to 2 Hz, for example. In this manner, the frequency F is decreased by the predetermined value f to maintain the frequency F at as large a value as possible, and the low pressure Ls is increased while reducing the load on the compressor 10 that is caused by a large fluctuation in frequency F, to thereby prevent the compressor 10 from stopping operation.

(Steps S206 and S207)

The control unit 31 overwrites the frequency $F_\alpha$ with the current frequency F (Step S206), and determines whether or not the instruction to end the defrosting operation has been issued (Step S207). When the instruction has not been issued, the processing returns to Step S202, and the processing of from Step S204 to Step S206 is repeatedly performed until the frequency F at which the low pressure Ls of the compressor 10 takes a value of the second threshold value $Ls_{th2}$ or more is obtained. As a result, with the stepwise decrease in frequency F, the low pressure Ls is increased stepwise until reaching the second threshold value $Ls_{th2}$ or more. When the control unit 31 issues the instruction to end the defrosting operation in Step S207 described above, the frequency control for the compressor 10 is also ended. Step S207 is described as processing after Step S206 for convenience. However, Step S207 is interrupt processing, and the defrosting operation is ended even in the middle of Step S201 to Step S206 described above when the instruction to end the defrosting operation is issued.

The frequency control for the compressor 10 is performed as described above, and with the frequency control, the low pressure Ls of the compressor 10 is controlled to be a value that is as small as possible and is more than the second threshold value $Ls_{th2}$. Therefore, in Step S104 of FIG. 5 described above, when the low pressure Ls becomes the first threshold value $Ls_{th1}$ or more, and the processing proceeds to Step S105, the defrosting time period is set to $T_1$ minutes, which is longer than $T_2$ minutes as a result. In other words, in a related-art air-conditioning apparatus, the frequency of the compressor is determined as a fixed value that is relatively low such that the low pressure does not fall below the first threshold value. In contrast, in Embodiment 1, the defrosting time period is not set to the fixed value but is changed depending on the low pressure Ls. Then, the initial frequency $F_1$ of the compressor 10 is set to a value that is relatively high, and the frequency F is controlled toward the direction of being decreased as necessary, to thereby prevent the low pressure Ls from being lowered. Therefore, in the processing of FIG. 5, the processing proceeds to Step S105 after Step S104, and the defrosting time period can be prolonged.

[Root Ice Eliminating Operation Control]

When the defrosting operation is ended as described above, the heating operation is resumed, but in the heating operation after the defrosting operation is ended, the root ice eliminating operation is performed.

Figure 7:
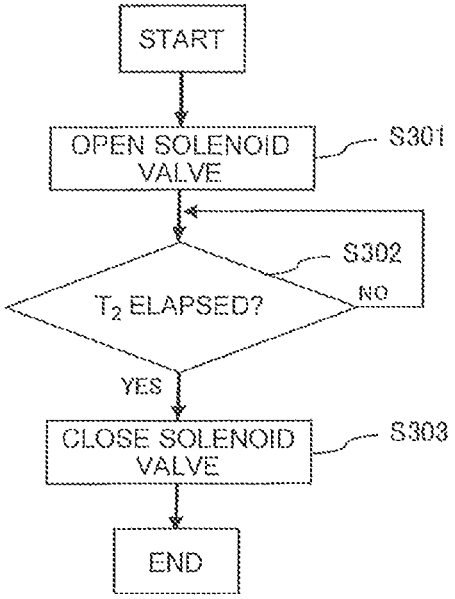
FIG. 7 is a flow chart for illustrating root ice eliminating operation control performed by the control unit during the heating operation in the air-conditioning apparatus of FIG. 1.

FIG. 7 is a flow chart for illustrating root ice eliminating operation control, which is performed by the control unit 31 during the heating operation. In the root ice eliminating operation control, when a set time at which the root ice eliminating operation control is started after the heating operation is resumed arrives, the control unit 31 starts the processing of FIG. 7.

As illustrated in FIG. 7, when the root ice eliminating operation control is started, the control unit 31 controls the solenoid valve 11, which is provided in the pipe **4*f* to serve as the bypass, to be opened, to thereby increase the flow rate of the refrigerant flowing through the solenoid valve 11 (Step S301). Then, the control unit 31 determines whether or not time $t_2$ has elapsed since the solenoid valve 11 is opened (Step S302), and when the time $t_2$ has elapsed, closes the solenoid valve 11 to end the processing (Step S303**). The time $t_2$ is set to 1 minute, for example.

In the root ice eliminating operation control, as the set time, 10 minutes after the start of the heating operation, at which it is assumed that the refrigerant is sufficiently heated, and 15 minutes after the start of the heating operation, at which root ice that remains without being melted is melted reliably, are set. The root ice eliminating operation control of FIG. 7 is performed a plurality of times, with the result that root ice can be eliminated reliably. The root ice eliminating operation control may be further performed thereafter as necessary.

In the above description, the temperature sensor 18 for determining the presence or absence of frost is provided at a position at which the pipe temperature can be detected. However, there may be adopted a configuration in which the temperature around the heat source-side heat exchanger 5 is detected as a temperature at which frost is generated, and the position at which the temperature sensor 18 is mounted is not limited.

According to the air-conditioning apparatus 100 of Embodiment 1 described above, the low pressure Ls of the compressor 10 is compared with the first threshold value $Ls_{th1}$, and the defrosting operation time period is changed based on the comparison result. In this manner, a defrosting operation time period corresponding to the low pressure Ls can be obtained, and a large amount of adhering frost can be melted while the appropriate operation of the compressor 10 is maintained. For example, when the low pressure Ls, which is a pressure on the suction side of the compressor 10, is the first threshold value $Ls_{th1}$ or more, the defrosting operation time period is set longer than that when the low pressure Ls is less than the first threshold value $Ls_{th1}$. When the defrosting operation time period is set longer, the amount of heat with which frost adhering to the heat source-side heat exchanger 5 of the outdoor unit is also increased, and defrosting is performed more reliably.

Moreover, according to the air-conditioning apparatus 100 of Embodiment 1, the frequency F of the compressor 10 is decreased when the low pressure Ls falls below the second threshold value $Ls_{th2}$. Therefore, the reduction in low pressure Ls of the compressor 10 can be avoided, and the defrosting operation time period can be prolonged.

Further, according to the air-conditioning apparatus 100 of Embodiment 1, when the value detected by the pressure sensor 19 is the first threshold value $Ls_{th1}$ or more, the controller 3 sets the defrosting operation time period to the first defrosting operation time period $T_1$ (minutes). Meanwhile, when the value detected by the pressure sensor 19 is less than the first threshold value $Ls_{th1}$, the controller 3 sets the defrosting operation time period to the second defrosting operation time period $T_2$ (minutes). In this manner, the frequency F of the compressor 10 is controlled such that the reduction in low pressure Ls of the compressor 10 can be avoided. Therefore, the state in which the low pressure Ls is the first threshold value $Ls_{th1}$ or more is maintained, with the result that the defrosting operation time period is set to the first defrosting operation time period $T_1$ (minutes) to increase the defrosting operation time period, and hence that the large amount of adhering frost can be melted.

Further, according to the air-conditioning apparatus 100 of Embodiment 1, when the temperature of the heat source-side heat exchanger 5 is maintained at the defrosting temperature X, it is determined that defrosting is completed to end the defrosting operation, with the result that the defrosting operation is not prolonged unnecessarily.

Further, according to the air-conditioning apparatus 100 of Embodiment 1, even when the zeotropic refrigerant mixture, which tends to generate frost, is used, defrosting can be performed without any remaining frost.

Further, according to the air-conditioning apparatus 100 of Embodiment 1, the base heat exchanger 12 is provided in the lower portion of the heat source-side heat exchanger 5. The air-conditioning apparatus 100 further includes the pipe 4*f*, which serves as a bypass t to which compressed refrigerant that is discharged from the compressor 10 branches to pass through the base heat exchanger 12, to thereby return to the compressor 10, and the solenoid valve 11, which is provided in the pipe 4*f* and is normally closed. After ending the defrosting operation and transitioning to the heating operation, the controller 3 opens and closes the solenoid valve 11 a plurality of times. Therefore, root ice, which is generated from water that is generated when frost is melted, can be melted, with the result that the occurrence of the failure of the air-conditioning apparatus and other problems that are caused by root ice can be prevented.

REFERENCE SIGNS LIST

1 outdoor unit 2 indoor unit 3 controller 4 cooling pipe 4*a*, 4*b*, 4*c*, 4*d*, 4*e*, 4*f*, 4*g* pipe 5 heat source-side heat exchanger 6 check valve 7 refrigerant flow switching device 8 accumulator 9 outdoor space 10 compressor 11 solenoid valve 12 base heat exchanger 13 indoor space 14 use-side heat exchanger 15 expansion device 16 indoor unit fan 17 outdoor unit fan 18 temperature sensor 19 pressure sensor 31 control unit 32 timer 33 memory 100 air-conditioning apparatus

The invention claimed is:

1. An air-conditioning apparatus comprising:

a refrigerant circuit that connects, a compressor, a refrigerant flow switching device, a heat source-side heat exchanger, an expansion device, and a use-side heat exchanger via a refrigerant pipe to form a refrigeration cycle;

a pressure sensor configured to detect a pressure on a suction side of the compressor; and a controller configured to, in a defrosting operation, control the refrigerant flow switching device to supply compressed refrigerant from the compressor to the heat source-side heat exchanger, perform a comparison to compare a value detected by the pressure sensor with a first threshold value, and change a defrosting operation time period based on a result of the comparison, the defrosting operation time period comprising a first defrosting operation time period and a second defrosting operation time period which is shorter than the first defrosting operation time period, periodically perform processing of comparing the value detected by the pressure sensor with a second threshold value which is more than the first threshold value, and decrease a frequency of the compressor when the value detected by the pressure sensor is less than the second threshold value, the controller being configured to set the defrosting operation time period to the first defrosting operation time period when the value detected by the pressure sensor is equal to, or greater than, the first threshold value, and set the defrosting operation time period to the second defrosting operation time period when the value detected by the pressure sensor is less than the first threshold value.

2. The air-conditioning apparatus of claim 1, further comprising a temperature sensor configured to measure a temperature of the heat source-side heat exchanger, wherein the controller is configured to compare the temperature of the heat source-side heat exchanger with a reference temperature, and end the defrosting operation when a state in which the temperature of the heat source-side heat exchanger is the reference temperature or more is maintained.

3. The air-conditioning apparatus of claim 1, wherein the refrigerant comprises a zeotropic refrigerant mixture.

4. The air-conditioning apparatus of claim 1, further comprising:

a base heat exchanger provided in a lower portion of the heat source-side heat exchanger;

a bypass that extends from a discharge pipe connected to the compressor through the base heat exchanger and to an inlet pipe connected to the compressor to pass the compressed refrigerant discharged from the compressor through the base heat exchanger and to return the refrigerant to the compressor; and a solenoid valve provided in the bypass and being normally closed, wherein the controller is configured to open and close the solenoid valve a plurality of times after the defrosting operation is ended and the air-conditioning apparatus transitions to a heating operation by changing a flow direction in the refrigerant flow switching device of the refrigerant circuit.

* * * * *